US007194102B2

(12) United States Patent
Harvey

(10) Patent No.: US 7,194,102 B2
(45) Date of Patent: Mar. 20, 2007

(54) IN-EAR MONITOR WITH HYBRID DUAL DIAPHRAGM AND SINGLE ARMATURE DESIGN

(75) Inventor: Jerry J. Harvey, Las Vegas, NV (US)

(73) Assignee: Ultimate Ears, LLC, Irvine, CA (US)

( * ) Notice: Subject to any disclaimer, the term of this patent is extended or adjusted under 35 U.S.C. 154(b) by 166 days.

(21) Appl. No.: 11/044,510

(22) Filed: Jan. 27, 2005

(65) Prior Publication Data

US 2006/0133630 A1 Jun. 22, 2006

Related U.S. Application Data

(63) Continuation-in-part of application No. 11/034,144, filed on Jan. 12, 2005.

(60) Provisional application No. 60/639,407, filed on Dec. 22, 2004, provisional application No. 60/639,173, filed on Dec. 22, 2004.

(51) Int. Cl.
*H04R 25/00* (2006.01)

(52) U.S. Cl. ..... 381/328; 381/324

(58) Field of Classification Search ..... 381/23.1, 381/321–324, 328, 380, 418; 379/428.01, 379/430; 455/344, 575.1, 575.2
See application file for complete search history.

(56) References Cited

U.S. PATENT DOCUMENTS

| | | | | |
|---|---|---|---|---|
| 3,819,860 | A * | 6/1974 | Miller | 381/380 |
| 4,548,082 | A | 10/1985 | Engebrestson et al. | |
| 4,677,679 | A | 6/1987 | Killion | |
| 4,870,688 | A | 9/1989 | Voroba et al. | |
| 5,193,116 | A | 3/1993 | Mostardo | |
| 5,222,050 | A | 6/1993 | Marren et al. | |
| 6,072,885 | A * | 6/2000 | Stockham et al. | 381/321 |
| 6,137,889 | A | 10/2000 | Shennib et al. | |
| 6,205,227 | B1 | 3/2001 | Mahoney et al. | |
| 6,389,143 | B1 | 5/2002 | Leedom et al. | |
| 6,931,140 | B2 * | 8/2005 | Van Halteren et al. | 381/418 |
| 7,088,839 | B2 | 8/2006 | Geschiere et al. | |
| 2002/0025055 | A1 | 2/2002 | Stonikas et al. | |
| 2006/0045297 | A1 | 3/2006 | Houssmann | |

OTHER PUBLICATIONS

Jerry Harvey, Earworn Monitors: All Foldback, No Feedback, Live Sound International, Sep. 2001, Publisher: Live Sound International, Published in: US.

* cited by examiner

*Primary Examiner*—Sinh Tran
*Assistant Examiner*—Brian Ensey
(74) *Attorney, Agent, or Firm*—Patent Law Office of David G. Beck

(57) ABSTRACT

An in-ear monitor for use with either a recorded or a live audio source is provided. The disclosed in-ear monitor combines a pair of diaphragm drivers and a single armature driver within a single earpiece, thereby taking advantage of the capabilities of both types of driver. Preferably, the diaphragm is used to reproduce the lower frequencies while the higher frequencies are accurately reproduced by the armature driver. Such a hybrid design offers improved fidelity across the desired frequency spectrum and does so at a reduced cost in comparison to multiple armature designs. In addition to the two drivers, the disclosed in-ear monitor includes means for splitting the incoming signal into separate inputs for each driver. Typically this function is performed by a passive crossover circuit although an active crossover circuit can also be used. In at least one embodiment, acoustic dampers are interposed between at least one driver output and the eartip.

16 Claims, 4 Drawing Sheets

IN-EAR MONITOR WITH HYBRID DUAL DIAPHRAGM AND SINGLE ARMATURE DESIGN

CROSS-REFERENCES TO RELATED APPLICATIONS

This application is a continuation-in-part of U.S. patent application Ser. No. 11/034,144, filed Jan. 12, 2005, and claims the benefit of U.S. Provisional Patent Application Ser. Nos. 60/639,407, filed Dec. 22, 2004, and 60/639,173, filed Dec. 22, 2004, the disclosures of which are incorporated herein by reference for any and all purposes.

FIELD OF THE INVENTION

The present invention relates generally to audio monitors and, more particularly, to an in-ear monitor.

BACKGROUND OF THE INVENTION

In-ear monitors, also referred to as canal phones and stereo headphones, are commonly used to listen to both recorded and live music. A typical recorded music application would involve plugging the monitor into a music player such as a CD player, flash or hard drive based MP3 player, home stereo, or similar device using the monitor's headphone jack. Alternately, the monitor can be wirelessly coupled to the music player. In a typical live music application, an on-stage musician wears the monitor in order to hear his or her own music during a performance. In this case, the monitor is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, increased mobility for the musician and the reduction of ambient sounds.

In-ear monitors are quite small and are normally worn just outside the ear canal. As a result, the acoustic design of the monitor must lend itself to a very compact design utilizing small components. Some monitors are custom fit (i.e., custom molded) while others use a generic "one-size-fits-all" earpiece.

Prior art in-ear monitors use either diaphragm-based or armature-based receivers. Broadly characterized, a diaphragm is a moving-coil speaker with a paper or mylar diaphragm. Since the cost to manufacture diaphragms is relatively low, they are widely used in many common audio products (e.g., ear buds). In contrast to the diaphragm approach, an armature receiver utilizes a piston design. Due to the inherent cost of armature receivers, however, they are typically only found in hearing aids and high-end in-ear monitors.

Diaphragm receivers, due to the use of moving-coil speakers, suffer from several limitations. First, because of the size of the diaphragm assembly, a typical earpiece is limited to a single diaphragm. This limitation precludes achieving optimal frequency response (i.e., a flat or neutral response) through the inclusion of multiple diaphragms. Second, diaphragm-based monitors have significant frequency roll off above 4 kHz. As the desired upper limit for the frequency response of a high-fidelity monitor is at least 15 kHz, diaphragm-based monitors cannot achieve the desired upper frequency response while still providing accurate low frequency response.

Armatures, also referred to as balanced armatures, were originally developed by the hearing aid industry. This type of driver uses a magnetically balanced shaft or armature within a small, typically rectangular, enclosure. As a result of this design, armature drivers are not reliant on the size and shape of the enclosure, i.e., the ear canal, for tuning as is the case with diaphragm-based monitors. Typically, lengths of tubing are attached to the armature which, in combination with acoustic filters, provide a means of tuning the armature. A single armature is capable of accurately reproducing low-frequency audio or high-frequency audio, but incapable of providing high-fidelity performance across all frequencies. To overcome this limitation, armature-based in-ear monitors often use two, or even three, armature drivers. In such multiple armature arrangements, a crossover network is used to divide the frequency spectrum into multiple regions, i.e., low and high or low, medium, and high. Separate armature drivers are then used for each region, individual armature drivers being optimized for each region. Unfortunately, as armatures do not excel at low-frequency sound reproduction, even in-ear monitors using multiple armatures may not provide the desired frequency response across the entire audio spectrum. Additionally, the costs associated with each armature typically prohibit the use of in-ear monitors utilizing multiple armature drivers for most applications.

Although a variety of in-ear monitors have been designed, these monitors do not provide optimal sound reproduction throughout the entire audio spectrum. Additionally, those monitors that achieve even a high level of audio fidelity are prohibitively expensive. Accordingly, what is needed in the art is an in-ear monitor that achieves the desired response across the audio spectrum at a reasonable cost. The present invention provides such a monitor.

SUMMARY OF THE INVENTION

The present invention provides an in-ear monitor for use with either a recorded or a live audio source. The disclosed in-ear monitor combines a pair of diaphragm drivers and a single armature driver within a single earpiece, thereby taking advantage of the capabilities of both types of drivers. Preferably, the diaphragms are used to reproduce the lower frequencies while the higher frequencies are accurately reproduced by the armature driver. Such a hybrid design offers improved fidelity across the desired frequency spectrum and does so at a reduced cost in comparison to multiple armature designs. In addition to the three drivers, the in-ear monitor of the invention includes means for splitting the incoming signal into separate inputs for each driver. Typically this function is performed by a passive crossover circuit although an active crossover circuit can also be used. In at least one embodiment, acoustic dampers are interposed between one or more driver outputs and the eartip.

A further understanding of the nature and advantages of the present invention may be realized by reference to the remaining portions of the specification and the drawings.

DESCRIPTION OF THE SPECIFIC EMBODIMENTS

Figure 1:
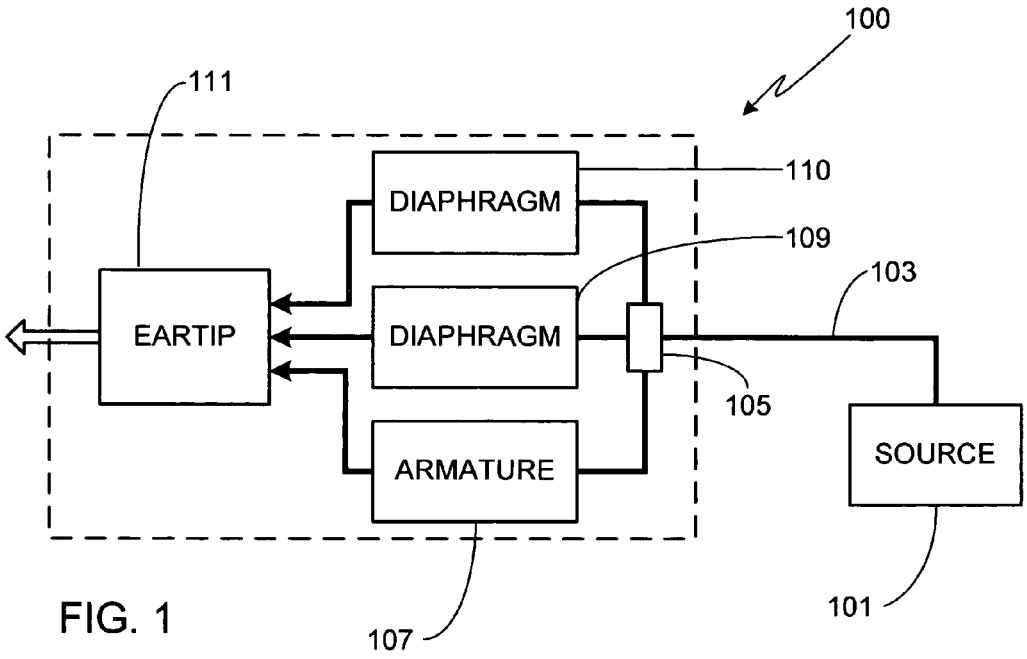
FIG. 1 schematically illustrates an in-ear monitor according to the invention with a wired system.

FIG. 1 is a block diagram of an in-ear monitor 100 in accordance with the invention. In this embodiment monitor 100 is coupled to source 101 via cable 103. Source 101 may be selected from any of a variety of sources such as an audio receiver, mixer, music player, headphone amplifier or other source type. The electrical signal from source 101 is feed through circuit 105 which provides input to armature driver 107 and a pair of diaphragm drivers 109/110, the electrical signal from source 101 representing the sound to be generated by in-ear monitor 100. The sounds produced by drivers 107, 109 and 110 are directed through an eartip 111 to the user.

Figure 2:
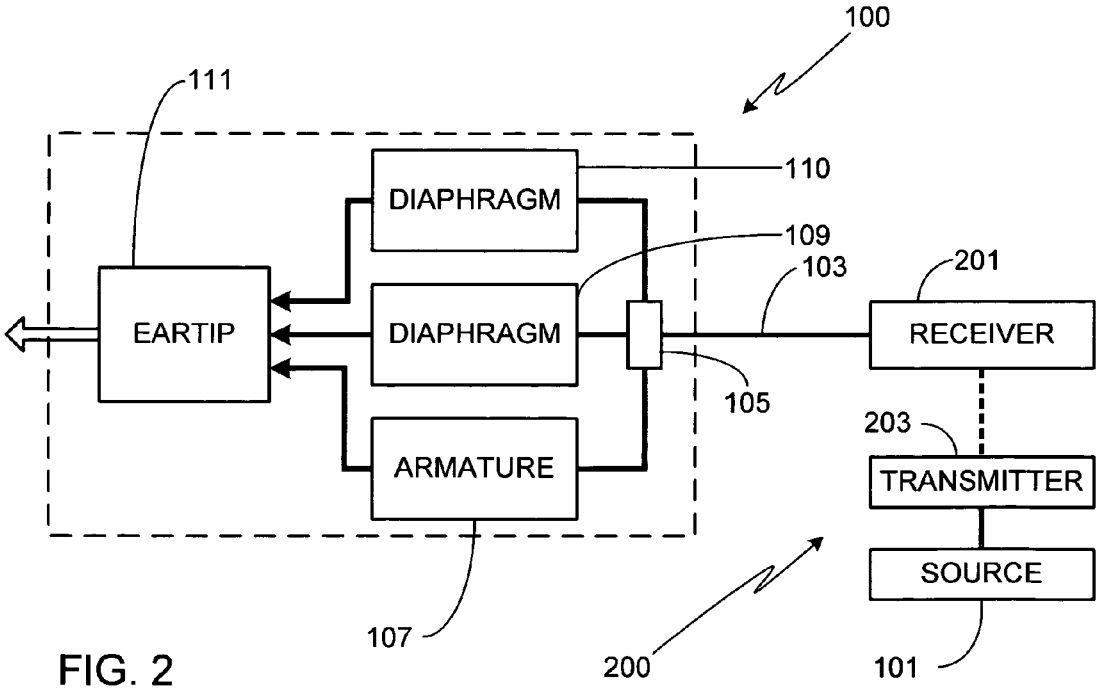
FIG. 2 schematically illustrates an in-ear monitor according to the invention with a wireless system.

FIG. 2 illustrates the use of in-ear monitor 100 with a wireless system. As shown, cable 103 is coupled to a receiver 201. Receiver 201 is wirelessly coupled to a transmitter 203 which is, in turn, coupled to source 101. If desired transmitter 203 and source 101 can be combined into a single device. It will be appreciated that in-ear monitor 100 is not limited to use with a specific source nor is it limited to the means used to couple the monitor to the source.

As previously noted, circuit 105 of in-ear monitor 100 sends input signals to both armature 107 and diaphragms 109 and 110. In at least one embodiment of the invention, circuit 105 is comprised of a passive crossover circuit. This passive crossover divides the incoming audio signal into a low-frequency portion and a high-frequency portion. The low-frequency portion is routed electrically to diaphragm drivers 109 and 110 while the high-frequency portion is routed electrically to armature 107. Diaphragm drivers 109 and 110 are preferably wired in phase. Passive crossover circuits are well known in the industry and as the present invention is not limited to a specific crossover design, additional detail will not be provided herein. In an alternate embodiment, circuit 105 is comprised of an active crossover circuit.

The invention can use any of a variety of armature and diaphragm designs and is not limited to a single design for either. As armature and diaphragm drivers are well known by those of skill in the art, additional details will not be provided herein. In at least one embodiment of the invention, armature 107 utilizes a split coil design, thus allowing in-ear monitor 100 to achieve a more uniform frequency response while also providing an impedance that is suitable for use with a greater variety of consumer audio products.

Figure 3:
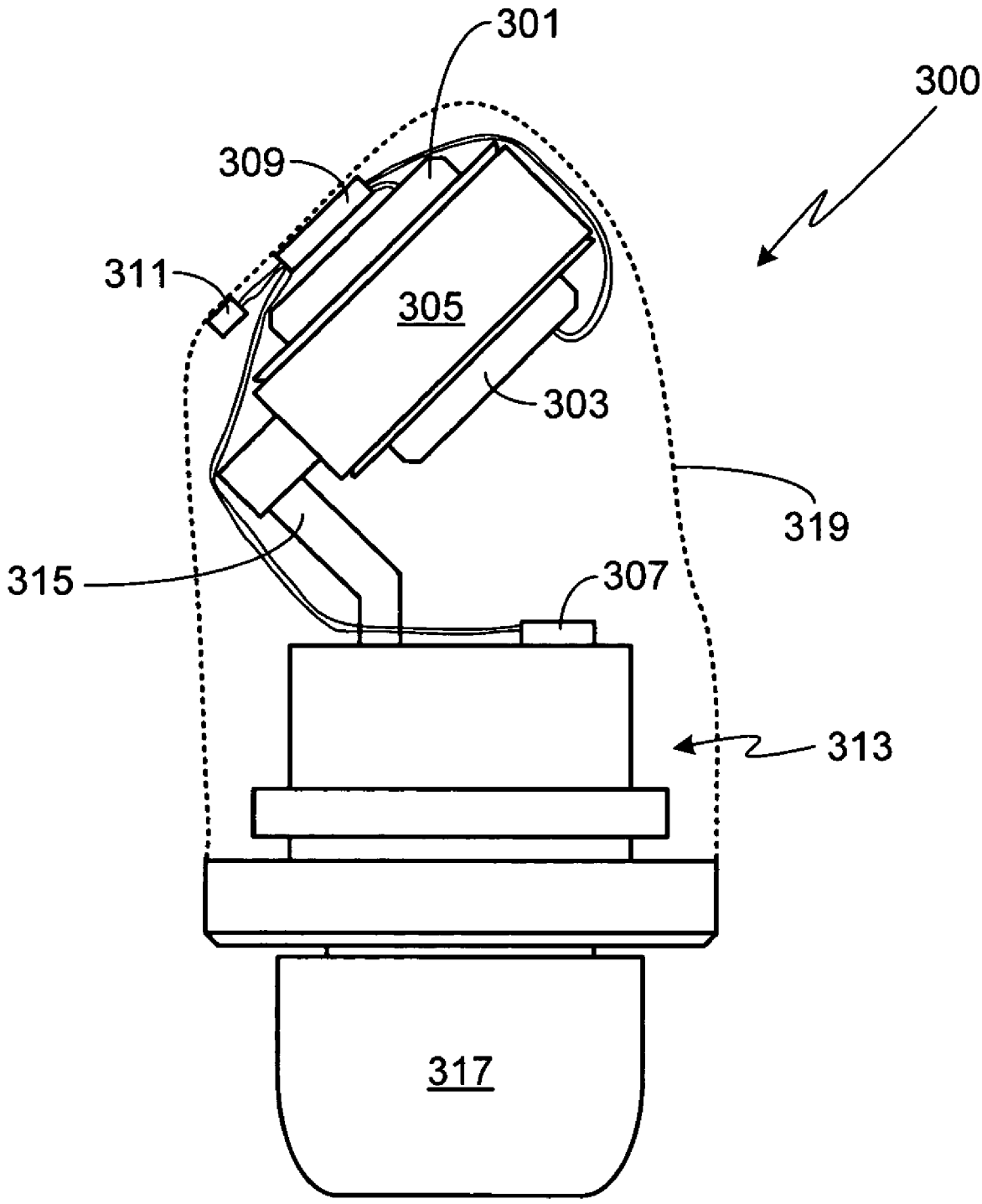
FIG. 3 illustrates the principal components of an in-ear monitor according to the invention.
Figure 4:
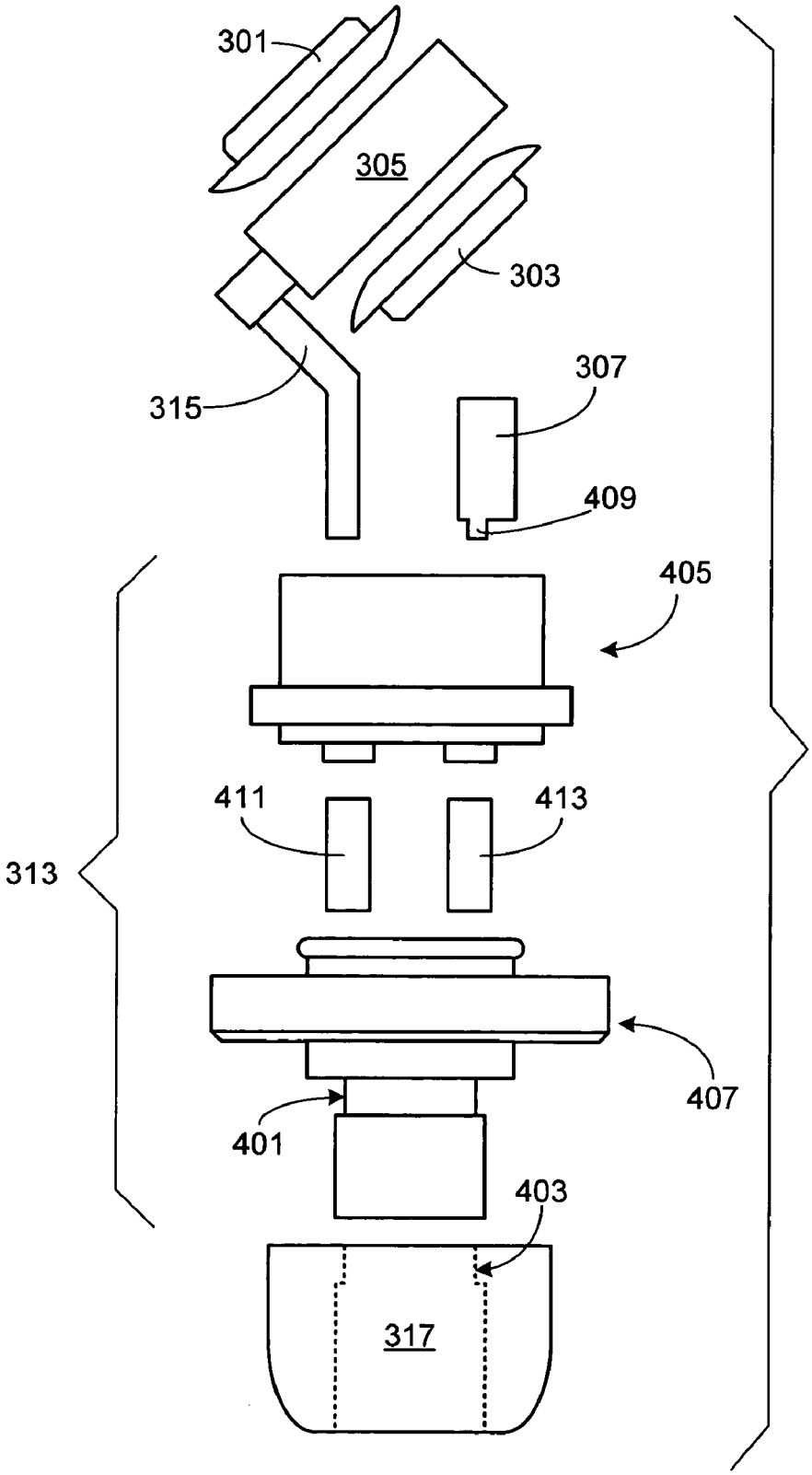
FIG. 4 is an exploded view of the embodiment shown in FIG. 3.
Figure 5:
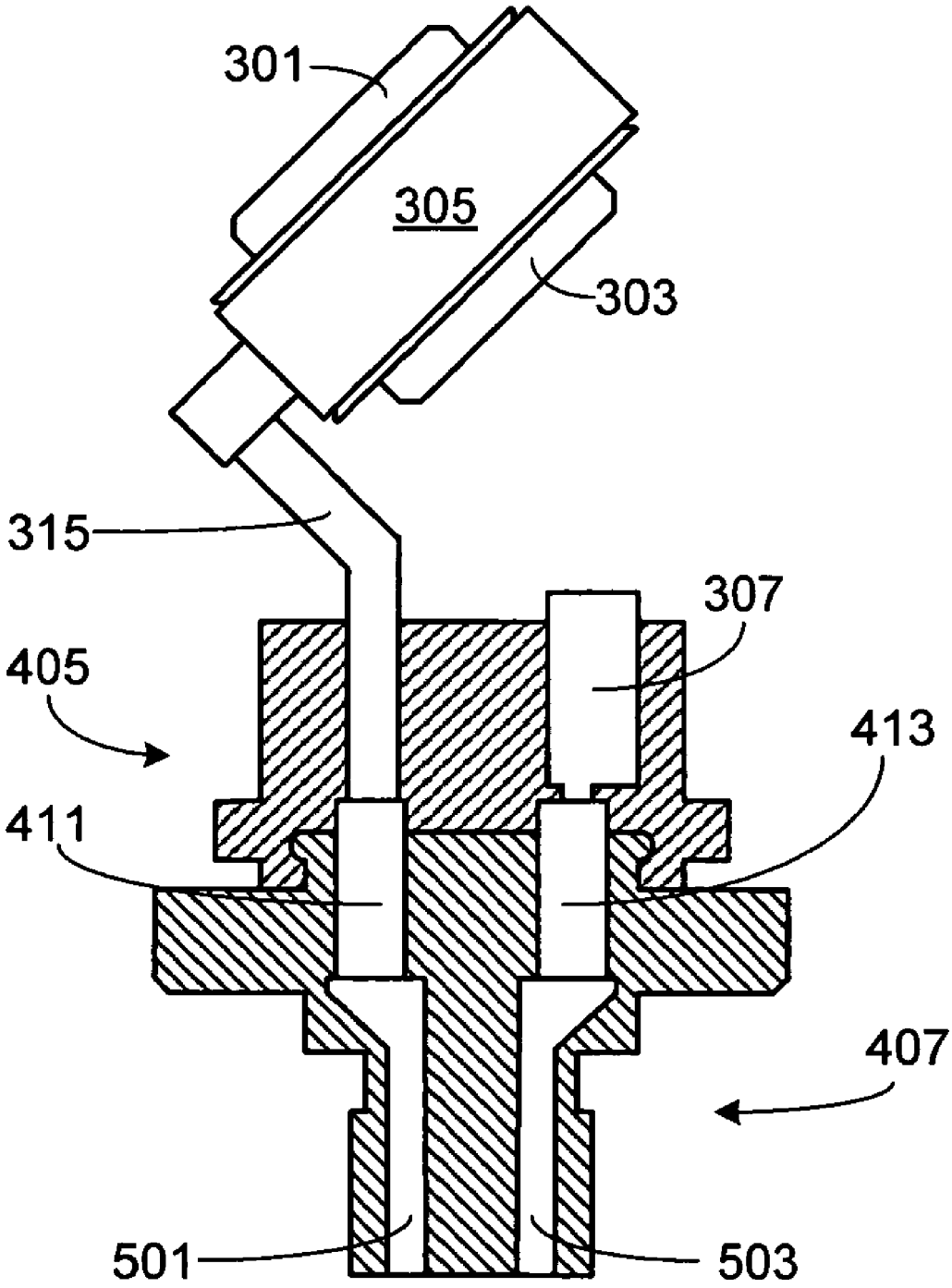
FIG. 5 is a cross-sectional view of the sound delivery assembly of FIGS. 3 and 4.

FIGS. 3–5 illustrate the primary components, not shown to scale, of a preferred embodiment of an in-ear monitor 300 in accordance with the invention. Monitor 300 includes a pair of diaphragm drivers 301 and 303. As illustrated, diaphragms 301 and 303 are mounted face-to-face within diaphragm housing 305. If desired, end caps (not shown) can be used to seal drivers 301 and 303 within enclosure 305. By mounting the diaphragm drivers in a "push-push" configuration, the effective size of a single diaphragm is essentially doubled. For example, assuming 13.5 millimeter diaphragms are used, the combination of diaphragms 301/303 as shown will produce low frequency sound energy comparable to that of a diaphragm greater than 20 millimeters in diameter. Thus, as a result of the present design, in-ear monitor 300 is capable of producing low frequency sound such as that normally only associated with large speakers.

In addition to diaphragm drivers 301/303, in-ear monitor 300 includes an armature driver 307. A circuit 309, for example a passive or an active crossover circuit as previously described, supplies a signal from an external source (not shown) to each of the three drivers. Circuit 309 is coupled to the external source by a cable (not shown), the cable either being hard-wired to circuit 309 or attached via a cable socket 311.

In the preferred embodiment, armature 307 is directly attached to a sound delivery assembly 313. A sound tube 315 interposed between diaphragm housing 305 and sound delivery assembly 313 acoustically couples diaphragms 301 and 303 to the sound delivery assembly 313. Sound delivery system 313 delivers the sound produced by the three drivers to an eartip 317. An outer earpiece enclosure 319, shown in phantom, attaches to sound delivery assembly 313. Earpiece enclosure 319 protects drivers 301, 303 and 307 as well as circuit 309 from damage while providing a convenient means of securing cable socket 311, or alternately a cable (not shown), to the in-ear monitor. Enclosure 319 can be attached to assembly 313 using an adhesive, interlocking members (e.g., a groove/lip arrangement), or by other means. Enclosure 319 can be fabricated from any of a variety of materials, thus allowing the designer and/or user to select the material's firmness (i.e., hard to soft), texture, color, etc. Enclosure 319 can either be custom molded or designed with a generic shape.

Eartip 317 is designed to fit within the outer ear canal of the user and as such, is generally cylindrical in shape. Eartip 317 can be fabricated from any of a variety of materials. Preferably eartip 317 is fabricated from a compressible material (e.g., elastomeric material), thus providing a comfortable fit for the user. As shown in the exploded view of FIG. 4 and the cross-sectional view of sound delivery assembly 313 of FIG. 5, sound delivery assembly 313 includes a channel or groove 401 into which a corresponding lip 403 on eartip 317 fits. The combination of an interlocking groove 401 with a lip 403 provides a convenient means of replacing eartip 317, allowing eartips of a various sizes, colors, materials, material characteristics (density, compressibility), or shape to be easily attached to sound delivery assembly 313. As a result, it is easy to provide the end user with a custom fit. Additionally, the use of interlocking members 401 and 403 allow worn out eartips to be quickly and easily replaced. It will be appreciated that other eartip mounting methods can be used with in-ear monitor 300 without departing from the invention. For example, in addition to interlocking flanges, eartip 317 can be attached to sound delivery assembly 313 using pressure fittings, bonding, etc.

Although sound delivery assembly 313 can utilize a single piece design, in the preferred embodiment of the invention sound delivery assembly 313 is comprised of a boot 405 and a damper housing 407. Boot 405 and damper housing 407 can be held together using any of a variety of means, including pressure fittings, bonding, interlocking flanges, etc. Preferably the means used to attach boot 405 to damper housing 407 is such that the two members can be separated when desired. In at least one embodiment of the invention, captured between members 405 and 407, and corresponding to driver outputs 315 and 409, is a pair of dampers 411 and 413. Alternately, a single damper can be used, corresponding to either driver output 315 or driver output 409. The use of dampers allows the output from the in-ear monitor 300 in general, and the output from diaphragms 301/303 and/or armature 307 in particular, to be tailored. Tailoring may be used, for example, to reduce the sound pressure level overall or to reduce the levels for a particular frequency range or from a particular driver. Damper housing 407 also includes a pair of conduits 501/503 that deliver the sound from the drivers through dampers 411 and 413 (if used) to eartip 317. Although the preferred embodiment keeps the sound conduits separate throughout housing 407, in an alternate embodiment sound conduits 501/503 converge in a "Y" fashion to a single output conduit (not shown).

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An in-ear monitor comprising:

an in-ear monitor enclosure;

a diaphragm enclosure disposed within said in-ear monitor enclosure;

a first diaphragm driver mechanically coupled to said diaphragm enclosure, wherein a first primary output surface of said first diaphragm driver is directed into said diaphragm enclosure;

a second diaphragm driver mechanically coupled to said diaphragm enclosure, wherein a second primary output surface of said second diaphragm driver is directed into said diaphragm enclosure and towards said first primary output surface of said first diaphragm driver;

a first acoustic output coupled to said diaphragm enclosure;

an armature driver disposed within said in-ear monitor enclosure and mechanically separate from said first and second diaphragm drivers, said armature driver having a second acoustic output;

a source input cable attached to said in-ear monitor enclosure, wherein said source input cable is coupleable to a source and receives an electrical signal from said source, wherein said electrical signal represents a sound to be generated by the in-ear monitor, wherein said source is external to said in-ear monitor enclosure, and wherein said source is selected from the group of sources consisting of music players, mixers and headphone amplifiers;

a circuit contained within said in-ear monitor enclosure and electrically coupled to said armature driver, said first diaphragm driver, said second diaphragm driver and said source input cable, wherein said electrical signal from said source is feed through said circuit, said circuit providing a first input signal to said armature driver and a second input signal to said first and second diaphragm drivers;

an in-ear monitor acoustic output; and a sound delivery assembly, said sound delivery assembly comprising a first sound conduit acoustically coupling said first acoustic output to said in-ear monitor acoustic output, and further comprising a second sound conduit acoustically coupling said second acoustic output to said in-ear monitor acoustic output.

2. The in-ear monitor of claim 1, further comprising a cable socket, wherein said source input cable is attached to said in-ear monitor enclosure and coupled to said circuit via said cable socket.

3. The in-ear monitor of claim 1, said circuit further comprising a passive crossover circuit, said passive crossover circuit supplying said first input signal to said armature driver and said second input signal to said first and second diaphragm drivers.

4. The in-ear monitor of claim 3, wherein said first and second diaphragm drivers receive said second input signal in phase.

5. The in-ear monitor of claim 1, said circuit further comprising an active crossover circuit, said active crossover circuit supplying said first input signal to said armature driver and said second input signal to said first and second diaphragm drivers.

6. The in-ear monitor of claim 5, wherein said first and second diaphragm drivers receive said second input signal in phase.

7. The in-ear monitor of claim 1, further comprising a first damper interposed between said first acoustic output and said in-ear monitor acoustic output.

8. The in-ear monitor of claim 1, further comprising a second damper interposed between said second acoustic output and said in-ear monitor acoustic output.

9. The in-ear monitor of claim 7, said first damper interposed between said first acoustic output and said first sound conduit.

10. The in-ear monitor of claim 8, said second damper interposed between said second acoustic output and said second sound conduit.

11. The in-ear monitor of claim 1, further comprising an eartip removably coupleable to said sound delivery assembly.

12. A method of operating an in-ear monitor, the method comprising the steps of:

coupling the in-ear monitor to an external source via a source input cable, wherein said external source is external to said in-ear monitor, and wherein said external source is selected from the group of external sources consisting of music players, mixers and headphone amplifiers;

receiving an electrical signal from said external source via said source input cable, said electrical signal representing a sound to be generated by the in-ear monitor;

separating said electrical signal into a first frequency portion and a second frequency portion;

delivering said first frequency portion of said electrical signal to an armature driver within the in-ear monitor;

outputting a first acoustic output from said armature driver in response to said first frequency portion of said electrical signal;

configuring a first diaphragm driver and a second diaphragm driver within a diaphragm enclosure so that a first primary output surface corresponding to said first diaphragm driver faces a second primary output surface corresponding to said second diaphragm driver;

delivering said second frequency portion of said electrical signal to said first diaphragm driver within the in-ear monitor;

outputting a second acoustic output from said first diaphragm driver in response to said second frequency portion of said electrical signal;

delivering said second frequency portion of said electrical signal to said second diaphragm driver within the in-ear monitor;

outputting a third acoustic output from said second diaphragm driver in response to said second frequency portion of said electrical signal;

combining said second and third acoustic outputs to form a fourth acoustic output;

combining said first acoustic output from said armature driver with said fourth acoustic output from said first and second diaphragm drivers; and delivering said combined first and fourth acoustic outputs to an in-ear monitor acoustic output.

13. The method of claim 12, wherein said step of combining said second and third acoustic outputs is performed within said diaphragm enclosure.

14. The method of claim 12, wherein said step of combining said first and fourth acoustic outputs is performed within a sound delivery assembly, wherein said method further comprises the step of coupling an eartip to said sound delivery assembly.

15. The method of claim 12, further comprising the step of damping said first acoustic output, wherein said damping step is performed prior to said step of combining said first and fourth acoustic outputs.

16. The method of claim 12, further comprising the step of damping said fourth acoustic output, wherein said damping step is performed prior to said step of combining said first and fourth acoustic outputs.

* * * * *